US005930574A

United States Patent [19]

Segawa

[11] Patent Number: 5,930,574

[45] Date of Patent: Jul. 27, 1999

[54] DEVICE SIMULTANEOUSLY CLEANING ELECTROSTATOGRAPHIC FIXING AND AUXILIARY HEATING ROLLERS

[75] Inventor: Yuichi Segawa, Osaka, Japan

[73] Assignee: Mita Industrial Co., Ltd., Osaka, Japan

[21] Appl. No.: 09/121,832

[22] Filed: Jul. 24, 1998

[30] Foreign Application Priority Data

Jul. 26, 1997 [JP] Japan ..... 9-215853

[51] Int. Cl.[6] ..... G03G 15/20

[52] U.S. Cl. ..... 399/327; 15/256.51

[58] Field of Search ..... 399/324–327; 156/256.51, 256.53

[56] References Cited

U.S. PATENT DOCUMENTS 5,649,130 7/1997 Nakajima et al. ..... 399/327

*Primary Examiner*—Arthur T. Grimley
*Assistant Examiner*—William A. Noē
*Attorney, Agent, or Firm*—Shinjyu An Intellectual Property Firm

[57] ABSTRACT

Auxiliary heating roller(s) employed in an electrostatographic fixing station are cleaned at low cost by the efficient use of the reverse side of a disposable cleaning web which conventionally has been discarded after using its one side alone. Cleaning web devices 15 and 16 are installed in top and bottom ends of a fixing station, wherein auxiliary heating rollers 5 and 6 ride respectively on a heating roller 3 and a pressure roller 4 of a fixing roller pair. The cleaning web devices 15 and 16 are configured therein to clean the fixing rollers initially, employing an obverse side A of a cleaning web 21 in the respective devices, which winds around turnaround rollers such that thereafter the reverse side B of the cleaning web 21 is employed to clean the surfaces of the auxiliary heating rollers 5 and 6.

2 Claims, 5 Drawing Sheets

DEVICE SIMULTANEOUSLY CLEANING ELECTROSTATOGRAPHIC FIXING AND AUXILIARY HEATING ROLLERS

BACKGROUND OF THE INVENTION

1. Technical Field

The present invention relates to cleaning web devices in the fixing station of electrostatographic printing apparatus, such as electrostatic photocopying machines, printers, and facsimile machines; in particular the present invention relates to such cleaning web devices wherein employed in fixing stations configured with auxiliary heating rollers riding on the fixing rollers.

2. Description of Related Art

In electrostatographic printing devices, printing sheets carrying a toner-developed image are conveyed to a fixing station typically having a heating roller against which a pressure roller presses. The toner image is fuse-fixed onto the printing sheets as they are nipped by the pair of rollers in conveyance to the fixing station. In the fixing process, toner particles thus cling to the surface of the heating roller, and consequently a cleaning device is provided in the fixing station for cleaning the heating roller.

Toner that does not get cleaned from the surface of the heating roller may stick to the surface of the pressure roller due to its different separative properties from the heating roller. Further, in double-sided image fixing processes in electrostatographic printing devices, toner may stick to the surface of the pressure roller. Consequently, a cleaning device for the pressure roller is also provided.

Examples of such cleaning devices include unit devices in which a cleaning web that is prepared by impregnating a heat-resistant paper or the like with a parting agent such as silicone oil is stretched from a web feed reel to a web take-up reel, bringing one surface of the cleaning web into contact with the roller surface to be cleaned. The cleaning web is wound at a predetermined rate, and as the roller it contacts rotates, toner sticking to the roller surface is stripped off by the cleaning web.

A problem in thus employing a cleaning web, however, is that in bringing the web into cleaning contact with the roller a major portion of the parting agent contained in the web is applied to the roller surface. Accordingly, if after using one side of a cleaning web, the other side were to be used for another roller cleaning, the amount of parting agent applied to the surface of the roller would be insufficient. Therefore, under the present circumstances only one side of the cleaning web is generally used and then it discarded, which is quite uneconomical.

Meanwhile, among fixing stations, which have a pair of fixing rollers (hereinafter distinctly referred to as a heating roller and a pressure roller, which is pressed against the heating roller), in order to externally heat the surface of that roller directly involved in the thermal fixing process, some are built such that an auxiliary heating roller rides, for example, on the heating roller.

Further, some fixing stations are configured, not only with an auxiliary heating roller riding on the heating roller of the fixing roller pair, but with another auxiliary heating roller riding on the pressure roller. In yet another configuration, the pressure roller alone is provided with an auxiliary heating roller, disposed to ride on the pressure roller surface.

Herein, heating and pressure rollers are selected which are superior in fixing-treated sheet separability, but wherein such rollers are selected, it becomes necessary furthermore to choose an auxiliary heating roller or rollers that is of high sheet separability.

That is, if the auxiliary heating roller is of low sheet separability, toner residual on the surface of the fixing rollers that was not cleaned off by the cleaning web device may get transferred to the surface of the auxiliary heating roller. It therefore becomes necessary to discriminate sheet separability in design selection of the fixing station rollers, taking separability into consideration in selecting the auxiliary roller material as well, so that in operation in an electrostatographic printing device the auxiliary heating roller is not contaminated.

Wherein the heating roller and pressure roller are in view of manufacturing costs relatively inexpensive—fluorocarbon-coated rollers, for example—if an auxiliary heating roller is selected of a material which is of higher sheet separability than the fixing rollers, this brings in the problem of a considerable rise in cost.

In this regard, if the auxiliary heating roller is to be a fluorocarbon-coated roller, one must select a heating roller and a pressure roller which are of lower separability than the auxiliary heating roller in order that is the auxiliary heating roller not be contaminated, giving rise to the problematic point that fixing-treated sheets become difficult to separate from the surfaces of the heating roller and the pressure roller.

Otherwise, if a cleaning device exclusive for the auxiliary heating roller is added, there is no need to for concern regarding its sheet separability in relation to that of the heating and pressure rollers, but this will increase the overall cost of the fixing station by a large margin.

SUMMARY OF THE INVENTION

An object of the present invention is to enable cleaning of an auxiliary heating roller utilizing disposable current cleaning webs efficiently, such that consequently in a fixing station provided with auxiliary heating rollers, a construction in which only heating roller and pressure roller separability with respect to fixing-treated sheets need be pursued.

In accordance with this invention, there is provided a construction characterized in that: for a fixing station roller pair comprising a fixing roller on which an auxiliary heating roller rides, one side of a cleaning web containing a parting agent is nipped against the surface of the fixing roller; the other side of the cleaning web is nipped against the surface of the auxiliary heating roller; the cleaning web travels winding from a web feeding section to a web take-up section; wherein the surface of the fixing roller is cleaned by an obverse side of the cleaning web, and meanwhile the surface of the auxiliary heating roller is cleaned by the reverse side of the cleaning web.

Specifically, the surfaces of fixing rollers that are directly involved in thermal fixing are initially cleaned by one side of a cleaning web sufficiently containing a parting agent, so that sheet separability with respect to the surfaces of the fixing rollers is improved by the parting agent applied to the surfaces of the fixing rollers.

Thereafter, the other side of the web, conventionally discarded without being used, although free from contamination, is brought into cleaning contact with the surface of the auxiliary heating roller. Thus, the cleaning of an auxiliary heating roller is attained at considerably low cost, compared to the case where a separate cleaning device for an auxiliary heating roller is provided.

Such cleaning of an auxiliary heating roller eliminates the necessity for discriminating in separability between the fixing rollers and auxiliary heating rollers in designing the fixing station. This enables configuration of the fixing rollers wherein only separability with respect to fixing-treated sheets need be pursued, thus reducing overall costs of the fixing station.

After one side of a cleaning web is used for cleaning the surfaces of a fixing roller, the amount of parting agent contained in the cleaning web is decreased; however, it is enough to clean the surface of an auxiliary heating roller because contamination of the auxiliary heating roller is comparatively less significant, due to the small amount of toner that remains uncleaned from the surface of the fixing roller and that transfers to the auxiliary heating roller.

The foregoing and other objects, features, aspects and advantages of the present invention will become more apparent from the following detailed description, when taken in conjunction with the accompanying drawings.

DESCRIPTION OF THE PREFERRED EMBODIMENTS

Figure 1:
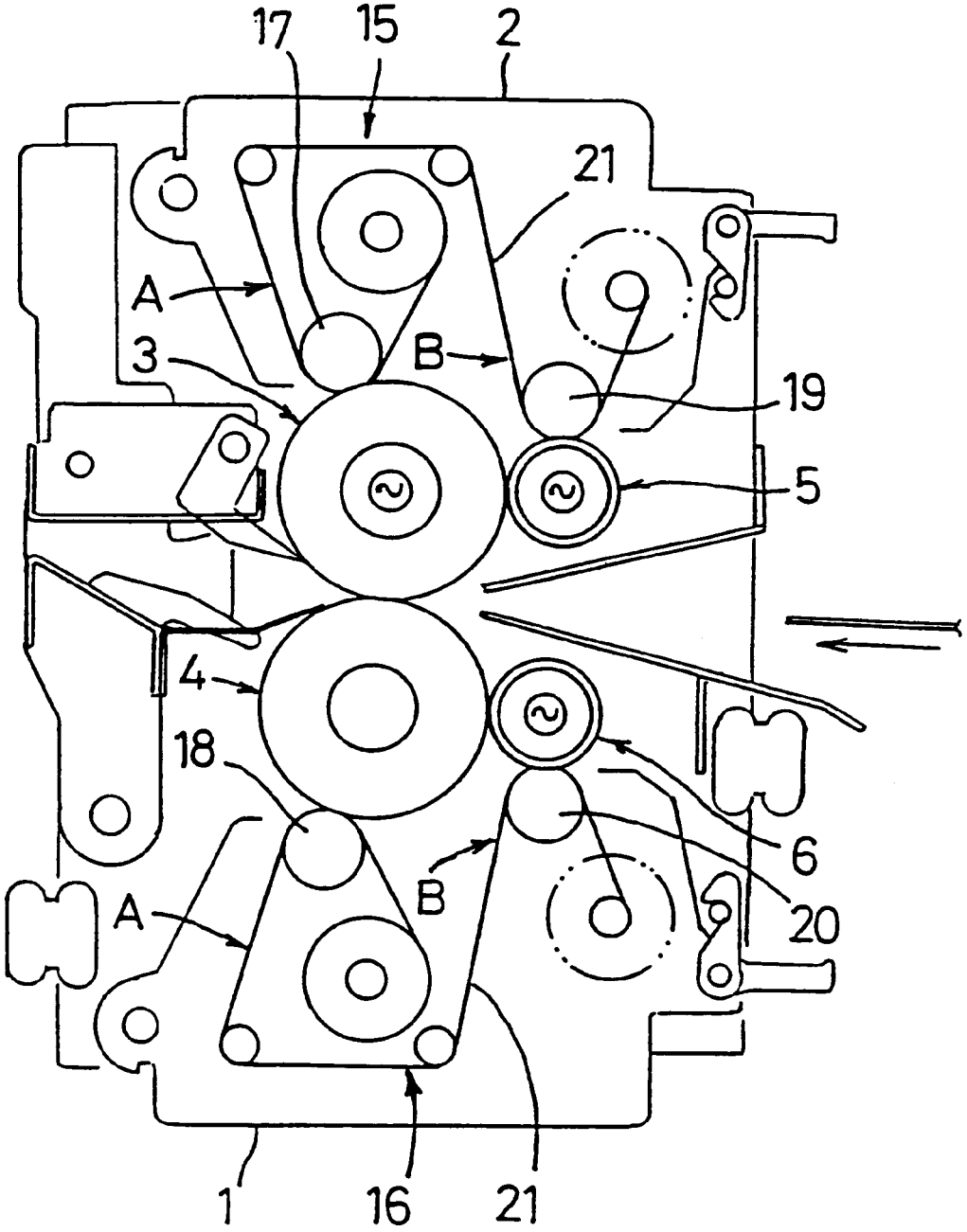
FIG. 1 is cross-sectional elevation of a fixing station in an electrostatographic printing apparatus in which cleaning web devices in accordance with the present invention are installed, with a toner-image bearing sheet partially depicted being fed toward the fixing station.

FIG. 1 illustrates a fixing station wherein a principal embodiment of the present invention is installed in an electrostatic photocopying machine (as an example of an electrostatographic printing apparatus). A heating roller 3 is disposed in an upper case 2 openable on a lower case 1. A pressure roller 4 that is pressed against the heating roller 3 when the upper and lower cases 1, 2 are shut together for operation is disposed in the lower case 1. An auxiliary heating roller 5 is further provided in the fixing station, axially adjacent to ride on the heating roller 3, and likewise an auxiliary heating roller. 6 is provided therein, axially adjacent to ride on the pressure roller 4.

Figure 2:
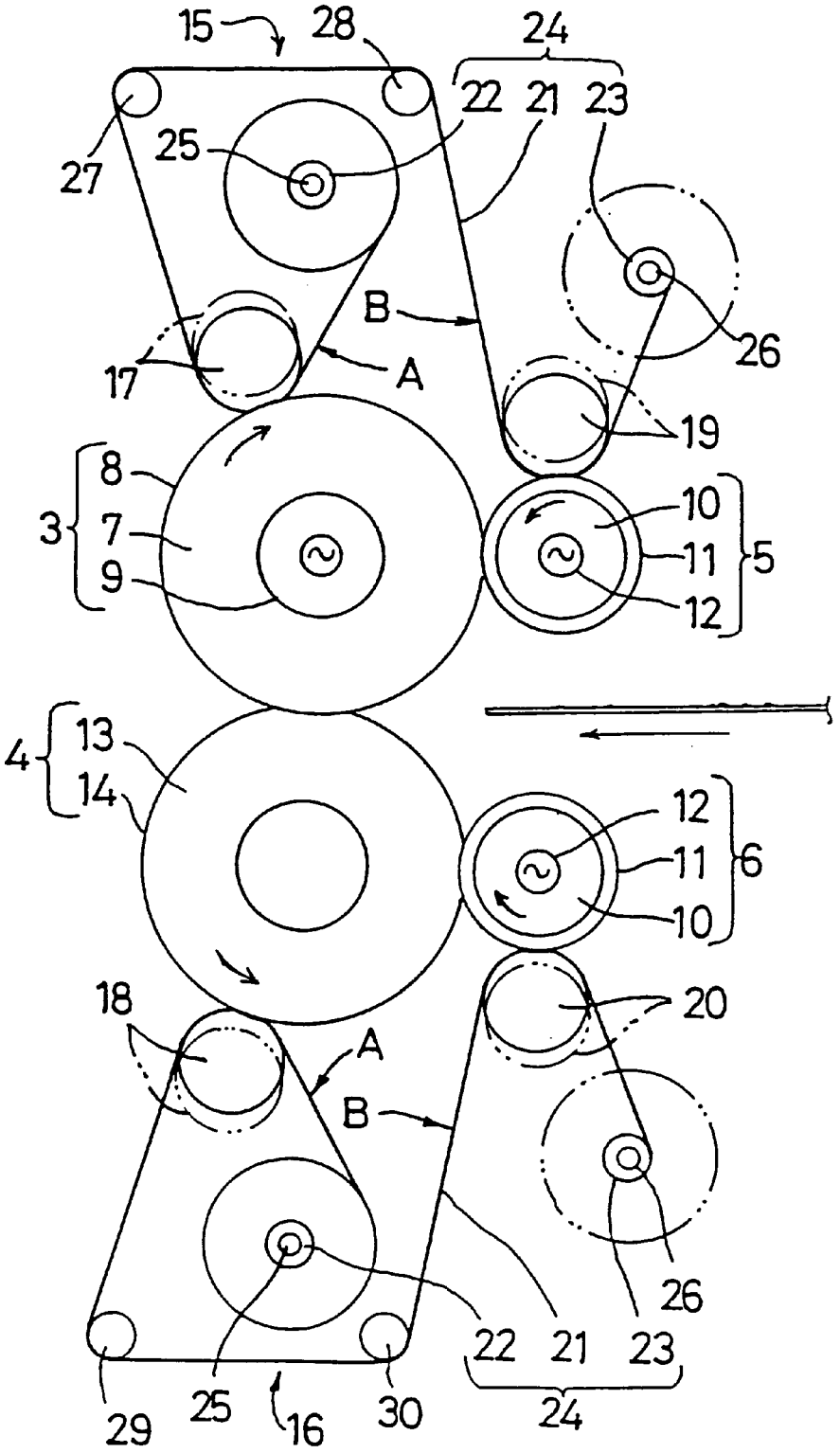
FIG. 2 is view corresponding to FIG. 1, slightly enlarged to highlight details of the cleaning web devices in relation to the fixing rollers and their respective auxiliary heating rollers.

Referring to FIG. 2, the heating roller 3 comprises a roller cylinder 7 of metal (aluminum for example), a fluorocarbon coating layer 8 that is inexpensive and moreover has excellent separability with regard to fixing-processed sheets, and a heater 9 housed in the roller cylinder 7. The auxiliary heating rollers 5 and 6 each include a roller cylinder 10 of metal (aluminum for example), a coating layer 11 of an inexpensive material which need not have any particular separative properties, and a heater 12 housed within the roller 10.

The auxiliary heating rollers 5 and 6 are located on the upstream side, in the sheet conveyance flow within the photocopying machine, of the heating rollers 3 and the pressure roller 4; moreover they are disposed to be in proximity to the nipping point of the roller pair 3, 4 to make the configuration thermally advantageous in view of the fixing process. Nevertheless, the auxiliary heating rollers 5 and 6 may be disposed in a locations apart from the nipping point.

The pressure roller 4 comprises a roller core 13 of metal (aluminum for example), and a coating layer 14 of a heat-resistant elastic substance (silicone rubber for example) formed on the surface of the roller core 13. A heater may also be provided, in the pressure roller 4 as need be.

As depicted in FIG. 2, in a fixing station configured as in the foregoing, cleaning web device 15 is disposed in an installation for cleaning the roller surfaces of the heating roller 3 and auxiliary heating roller 5 pair, and cleaning web device 16 is likewise disposed for cleaning the pressure roller 4 and auxiliary heating roller 6 pair.

Specifically, in installation the cleaning web devices 15, 16 include web-pressing rollers 17 to 20. First web-pressing rollers 17 and 19 are disposed to be pressible axially against heating roller 3 and pressure roller 4, respectively. Second web-pressing rollers 19 and 20 are disposed to be pressible axially against auxiliary heating rollers 5 and 6, respectively. A roll of cleaning web 21 containing a parting agent is wound onto a cleaning web feeding roller 22, and the unwinding edge of the cleaning web 21 is fastened to a cleaning web take-up roller 23, thereby to constitute a cleaning unit 24. The cleaning web feeding roller 22 and the cleaning web take-up roller 23 of the cleaning unit 24 therein pass the cleaning web 21 from a web feeding section 25 to a web take-up section 26 thus established respectively on the heating roller 3 and pressure roller 4 ends of the fixing station.

When installing the cleaning unit 24, for example on the heating roller 3 end, the cleaning web 21 winds around the web-pressing roller 17, nipped thereby against the heating roller 3, such that an obverse side A of the cleaning web 21 from the web feeding section 25 is brought into cleaning contact with the surface of the heating roller 3, traveling in a direction opposite to the rotational direction of the latter. Thereafter the cleaning web 21 winds on two turnaround rollers 27 and 28, such that the cleaning web 21 is turned around from the direction in which it is supplied from the web feeding section 25. The cleaning web 21 then winds around the web-pressing roller 19, nipped thereby against the auxiliary heating roller 5, such that the reverse side B of the cleaning web 21 (its inside surface in winding off the web feeding roller 22 of the web feeding section 25) is brought into cleaning contact with the surface of the auxiliary heating roller 5, traveling in a direction opposite to its rotational direction.

Likewise on the pressure roller 4 end, the cleaning web 21 winds around the web-pressing roller 18 such that initially obverse side A of the cleaning web 21 is nipped against the surface of the pressure roller 4, traveling in a direction opposite its rotation. Thereafter, the cleaning web 21 winds around two turnaround rollers 29 and 30 such that it is turned around from the direction in which it is supplied from the web feeding section 2S. similarly, winding around the web-pressing roller 20, the reverse side B of the cleaning web 21 is nipped against the surface of the auxiliary heating roller 6, the cleaning web 21 therein traveling in a direction opposite to the rotational direction of the auxiliary heating roller 6.

With the foregoing configuration, the surfaces of the heating roller 3 and the pressure roller 4, i.e., of the fixing roller pair, or those rollers directly involved in the thermal fixing process within the fixing station, are initially cleaned, by the A side of the cleaning web 21 containing sufficient parting agent. At that time parting agent is applied to the heating roller 3 and pressure roller 4 surfaces, thus improving the sheet separability with respect to the surfaces of both rollers.

Figure 3:
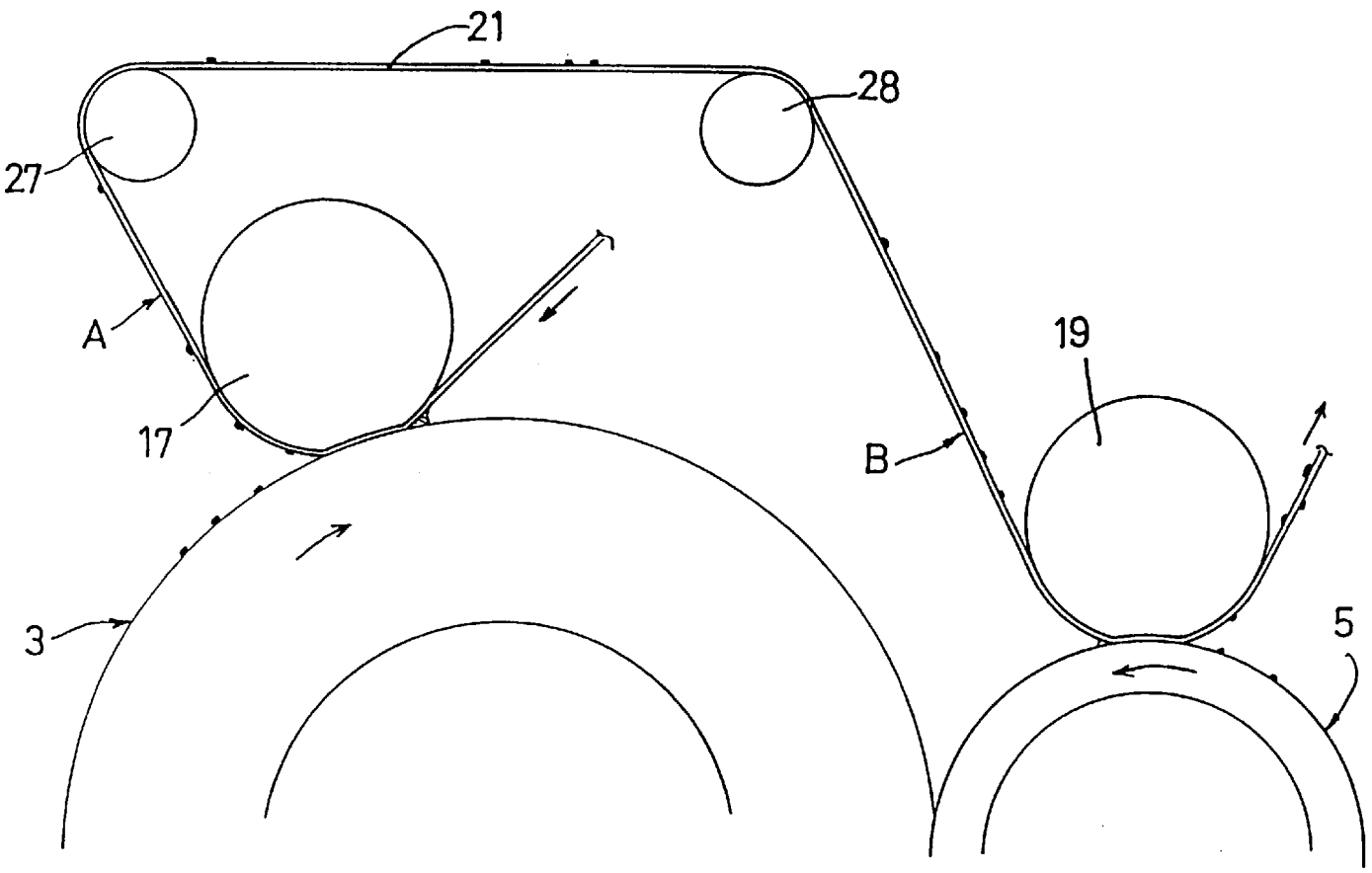
FIG. 3 is an enlarged schematic view illustrating web travel in a cleaning web device in accordance with the invention, in superficially cleaning a fixing roller and its associated auxiliary heating roller.

Thereafter, the surfaces of the auxiliary heating rollers 5 and 6 are cleaned by the B side, which is free from contamination, of the cleaning web 21, as illustrated in an exaggerated depiction in FIG. 3, which shows the cleaning web device 15 on the heating roller 3/auxiliary heating roller 5 end.

Accordingly, by a simple technique a disposable cleaning web 21 that conventionally has been discarded after using only one side is recycled in installation. The mere addition of the web-pressing rollers 19, 20 and turnaround rollers 27 to 30 accomplishes cleaning of the auxiliary heating rollers 5 and 6 at lower cost, compared to the case in which separate cleaning units for the auxiliary heating rollers is added.

Although in accordance with the above embodiment the cleaning web 21 is brought into contact with the surface of the fixing rollers in a direction traveling opposite to the fixing roller rotational direction, the cleaning web 21 may wind around a web-pressing roller traveling in the same direction as the rotational direction of the fixing roller against which the web is nipped.

Figure 4:
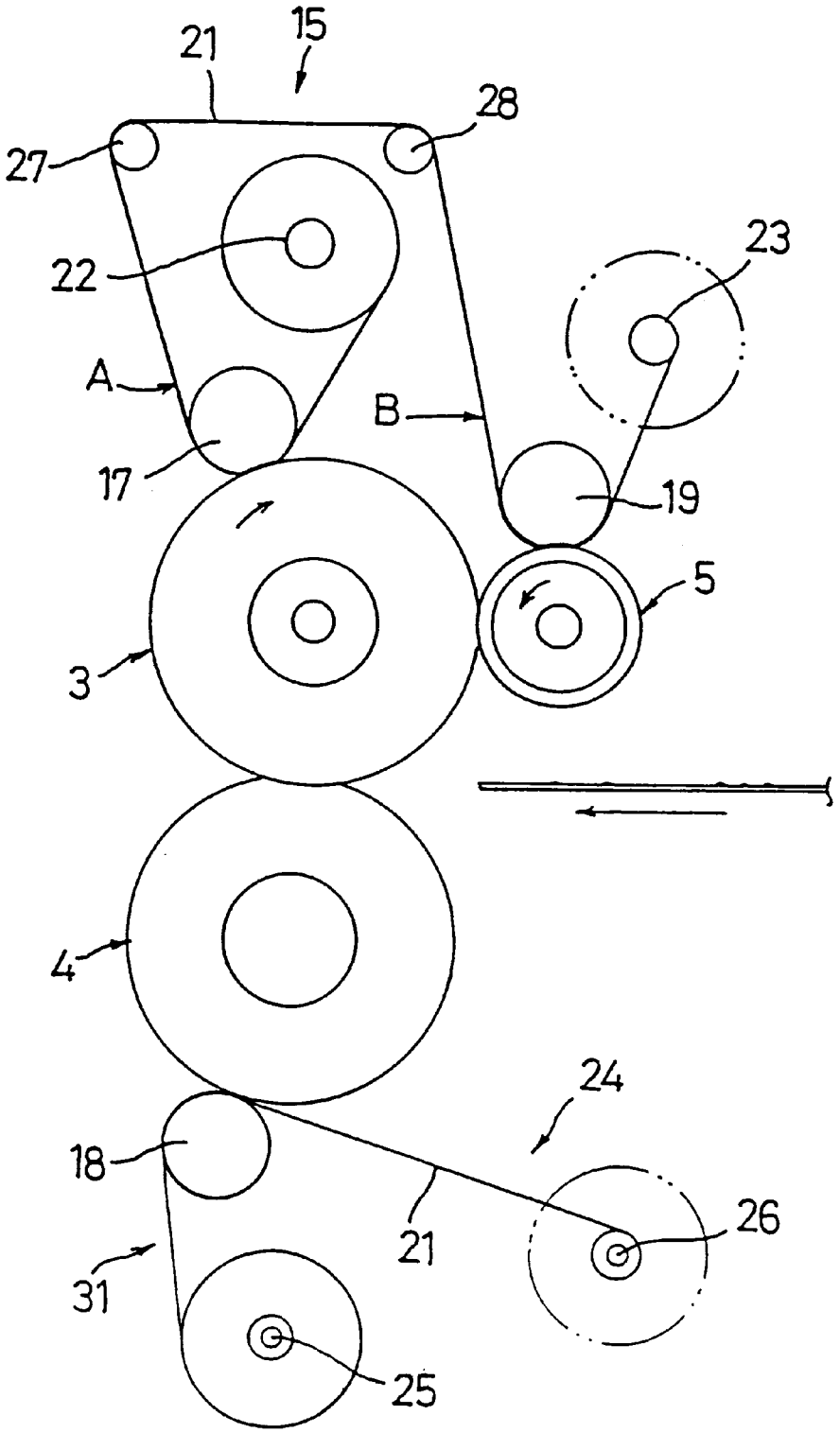
FIG. 4 is a view corresponding to FIG. 2, depicting a cleaning web device in accordance with the present invention in an fixing station example construction in which a lone auxiliary heating roller is employed, riding on the heating roller.

This is the case for example when, as illustrated in FIG. 4, the cleaning web device is employed to clean a fixing roller with no auxiliary heating roller. In the FIG. 4, a fixing station of a type in which only one of the fixing rollers is heated is shown, i.e., the heating roller 3 is heated by a lone auxiliary heating roller 5. Therein a cleaning web device 15 as above-described can be provided for the fixing/auxiliary heating roller pair 3 and 5. Meanwhile in respect of pressure roller 4, for which no auxiliary heating roller is provided, a pressure roller exclusive-use cleaning web device 31 may be provided such that by means of its web-pressing roller 18, one side of the cleaning web 21 is nipped against the surface of the pressure roller 4. Thereby cleaning unit 24 is installed on the pressure roller 4 end, with the cleaning web 21 as illustrated winding from the web feeding section 25 to the web take-up section 26.

Figure 5:
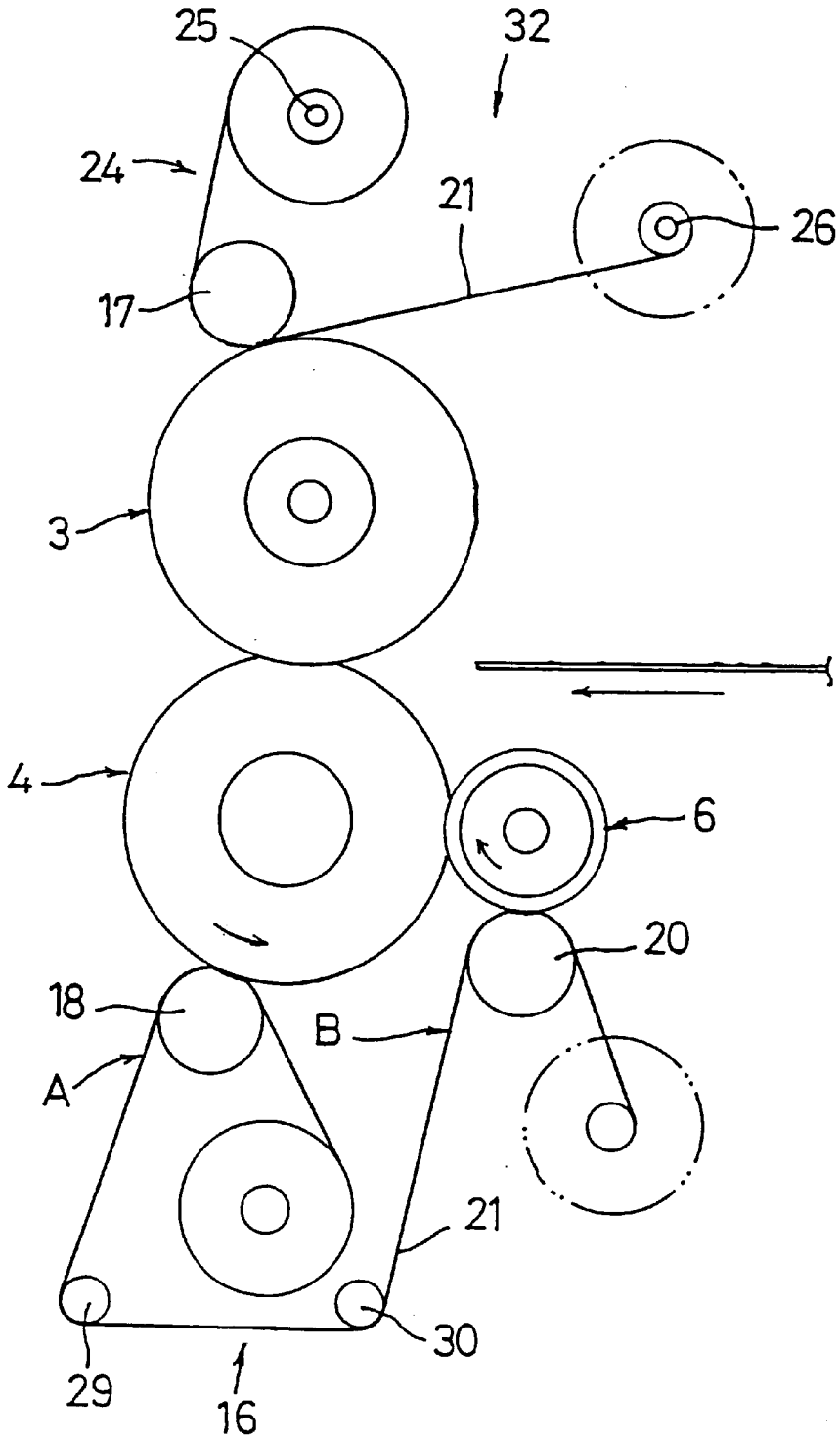
FIG. 5 is a view corresponding to FIG. 4, depicting a cleaning web device in accordance with the present invention in an fixing station example construction in which a lone auxiliary heating roller is employed, riding on the pressure roller.

With reference to FIG. 5, an alternative fixing station is depicted in which a single auxiliary heating roller 6 rides on the pressure roller 4 alone. Therein, the cleaning web unit 15 as above-described is provided for the fixing/auxiliary heating roller pair 4 and 6. On the heating roller 3 end, for which fixing roller no auxiliary heating roller is provided, a heating roller exclusive-use cleaning web device 32 may be provided such that by means of its web-pressing roller 17, one side of the cleaning web 21 is nipped against the surface of the heating roller 3. Thereby in this case a cleaning unit 24 is installed on the heating roller 3 end, again with the cleaning web 21 winding from the web feeding section 23 to the web take-up section 26.

As set forth in the foregoing, the unused, contaminant-free side of a disposable-type cleaning web which conventionally has been discarded after using its one side alone can in accordance with the present invention be efficiently employed to clean the auxiliary heating roller or rollers of an electrostatographic fixing unit. This enables low-cost cleaning of the auxiliary heating roller, by comparison to the case in which a separate cleaning device for the auxiliary heating roller is additionally provided. Furthermore, need for design discrimination in sheet-separability between the fixing unit and auxiliary heating rollers is eliminated, reducing the overall manufacturing costs of the fixing unit.

Various details of the present invention may be changed without departing from its spirit nor its scope. Furthermore, the foregoing description of the embodiments according to the present invention are provided for illustration only, and not for the purpose of limiting the invention as defined by the appended claims and their equivalents.

What is claimed is:

1. A cleaning web device of a fixing station which is provided with a pair of fixing rollers and at least one auxiliary heating roller that contacts one of the fixing rollers, characterized in being configured such that:

one side of a cleaning web containing a parting agent is brought into contact with the surface of the fixing roller contacted by the at least one auxiliary heating roller;

the other side of the cleaning web is brought into contact with the surface of the at least one auxiliary heating roller;

the cleaning web is moved as it is wound from a web feeding section to a web take-up section; and after the surface of said fixing roller contacted by the at least one auxiliary heating roller is cleaned by the one side of the cleaning web, the surface of the at least one auxiliary heating roller is cleaned by the other side face of the cleaning web.

2. A cleaning web device for use in an electrostatographic fixing station including a pair of fixing rollers, and at least one auxiliary heating roller axially parallel to and riding on one of the fixing rollers, the cleaning web device comprising:

a cleaning web feeding roll disposed substantially parallel to the fixing roller ridden by the at least one auxiliary heating roller;

a cleaning web take-up roll disposed substantially parallel to the ridden fixing roller and the at least one auxiliary heating roller;

a first web-pressing roller axially parallel to and riding on the ridden fixing roller;

a second web-pressing roller axially parallel to and riding on the at least one auxiliary heating roller; and at least one cleaning web turnaround roller disposed parallel to said first and second web-pressing rollers; wherein said cleaning web feeding roll, said at least one cleaning web turnaround roller, and said first and second web-pressing rollers are arranged such that a first side of a cleaning web traveling from the cleaning web feeding roll to the cleaning web take-up roll is pressed by said first web-pressing roller against the ridden fixing roller, and a second side of the cleaning web is pressed by said second web-pressing roller against the at least one auxiliary heating roller.

* * * * *